US010849443B2

(12) United States Patent
Windorski et al.

(10) Patent No.: US 10,849,443 B2
(45) Date of Patent: Dec. 1, 2020

(54) TABLE COVER

(71) Applicants: Kimberly Windorski, Leadville, CO (US); Gregory Windorski, Leadville, CO (US)

(72) Inventors: Kimberly Windorski, Leadville, CO (US); Gregory Windorski, Leadville, CO (US)

( * ) Notice: Subject to any disclaimer, the term of this patent is extended or adjusted under 35 U.S.C. 154(b) by 0 days.

(21) Appl. No.: 16/257,504

(22) Filed: Jan. 25, 2019

(65) Prior Publication Data

US 2019/0223634 A1 Jul. 25, 2019

Related U.S. Application Data

(60) Provisional application No. 62/621,899, filed on Jan. 25, 2018.

(51) Int. Cl.
*A47G 11/00* (2006.01)

(52) U.S. Cl.
CPC ..... *A47G 11/006* (2013.01); *A47G 11/004* (2013.01)

(58) Field of Classification Search
CPC .... A47G 11/006; A47G 11/003; A47G 11/004
USPC ..... 108/90
See application file for complete search history.

(56) References Cited

U.S. PATENT DOCUMENTS 2,728,165 A * 12/1955 La Claire ..... A47G 11/003 108/90
3,557,856 A * 1/1971 Berman ..... A47B 25/00 108/90
3,785,419 A * 1/1974 Sherlock ..... A47G 11/004 108/90
3,939,976 A 2/1976 Vanlseghem, Jr.
4,154,323 A * 5/1979 Sneider ..... A45C 9/00 190/2
4,185,673 A * 1/1980 Daniello ..... A45C 9/00 190/8
4,211,091 A * 7/1980 Campbell ..... A45C 11/20 383/110
4,688,286 A * 8/1987 Miker, Jr. ..... A45C 3/10 5/485
4,731,883 A * 3/1988 Foster ..... A41D 27/28 2/247
4,750,402 A * 6/1988 Markey ..... G10G 7/005 108/90
4,796,790 A * 1/1989 Hamilton ..... A45C 11/00 206/438
D318,971 S * 8/1991 Mitchell ..... D6/611
5,048,734 A * 9/1991 Long ..... A45C 11/20 150/901
5,339,748 A * 8/1994 Bilotti ..... A47G 11/004 108/90
5,598,923 A * 2/1997 Owens ..... A61B 50/312 150/130

(Continued)

*Primary Examiner* — Daniel J Troy
*Assistant Examiner* — Timothy M Ayres
(74) *Attorney, Agent, or Firm* — Boudwin Intellectual Property; Daniel Boudwin

(57) ABSTRACT

A table cover. The table cover includes a flexible base having a perimeter edge that can secure to a table such that an entirety of an upper surface of the table is covered by the base. A pair of panels are pivotally affixed to opposing ends of the base, wherein the pair of panels include a plurality of pockets on an exterior surface of the panel. At least one of the panels includes a thermally insulated lining therein.

11 Claims, 5 Drawing Sheets

(56) References Cited

U.S. PATENT DOCUMENTS 5,765,487 A * 6/1998 Neff ..... A47B 3/10 108/34
5,813,445 A * 9/1998 Christman ..... A63F 3/06 150/106
5,908,681 A * 6/1999 Foster ..... A47G 11/004 108/90
6,014,935 A * 1/2000 Willett ..... A47G 11/004 108/50.11
6,063,457 A 5/2000 Anderson
6,200,029 B1 * 3/2001 Bonta ..... B65D 81/3895 383/110
6,499,411 B2 * 12/2002 Brown ..... E04H 15/02 108/26
6,508,183 B2 1/2003 Kerrigan
7,322,315 B2 * 1/2008 Brewer ..... A01K 1/033 119/474
7,621,006 B1 * 11/2009 Tucker ..... A47G 9/0292 108/90
7,791,003 B2 * 9/2010 Lockhart ..... A45C 7/0063 219/387
8,209,995 B2 * 7/2012 Kieling ..... A45C 3/001 62/457.1
8,756,717 B2 * 6/2014 Claeys ..... A42B 1/04 2/250
9,512,557 B1 * 12/2016 Snipe ..... D06F 83/00
10,029,842 B2 * 7/2018 Seiders ..... A45C 11/20
2005/0158510 A1 7/2005 Trump
2005/0235529 A1 * 10/2005 Hsu ..... D06F 81/00 38/137
2009/0151040 A1 * 6/2009 Lee-Johnson ..... A41D 13/0012 2/51
2009/0151607 A1 6/2009 McLemore
2013/0276846 A1 * 10/2013 Courtney ..... E04H 15/56 135/121
2015/0272356 A1 * 10/2015 Stafford ..... A47G 11/004 108/90
2018/0319569 A1 * 11/2018 McGoff ..... B65D 81/3897
2019/0082812 A1 * 3/2019 Rizeakos ..... A45F 3/04

* cited by examiner

TABLE COVER

CROSS REFERENCE TO RELATED APPLICATIONS

This application claims the benefit of U.S. Provisional Application No. 62/621,899 filed on Jan. 25, 2018. The above identified patent application is herein incorporated by reference in its entirety to provide continuity of disclosure.

BACKGROUND OF THE INVENTION

The present invention relates to table covers. More particularly, the present invention pertains to table covers having a pair of panels affixed to opposing ends thereof, wherein the pair of panels include a plurality of thermally insulated pockets thereon for storing objects therein.

Many people enjoy having picnics, parties, or other outdoor events, however these events require a degree of organization in order to provide maximal enjoyment with minimal stress. Various event related objects must be stored within convenient reach for participants to easily access when needed, such as plates, utensils, cups, and the like. However, when hosting an event outside, storing these objects in an outdoor location exposes the objects to wind, dirt, debris, rain, and various other outdoor hazards. This can result in objects tipping over, spilling the contents thereof, or otherwise contaminating the objects or the surrounding area. Additionally, storage of these objects can take up an excessive amount of table space, preventing easy access to the table for other uses. Therefore, a device that can provide storage space for party and event supplies, while maximizing table surface for use is desired.

In light of the devices disclosed in the known art, it is submitted that the present invention substantially diverges in design elements from the known art and consequently it is clear that there is a need in the art for an improvement to existing table covers. In this regard, the instant invention substantially fulfills these needs.

SUMMARY OF THE INVENTION

In view of the foregoing disadvantages inherent in the known types of table covers now present in the known art, the present invention provides a table cover wherein the same can be utilized for providing convenience for the user when storing objects within pockets thereon, wherein the pockets are thermally insulated to maintain the temperature of objects stored therein.

The present system comprises a flexible base having a perimeter edge configured to secure to a table such that an entirety of an upper surface of the table is covered by the base. A pair of panels are pivotally affixed to opposing ends of the base, wherein the pair of panels each comprise a plurality of pockets on an exterior surface thereof. At least one of the plurality of pockets further comprises a thermally insulated lining therein, the thermally insulated lining configured to maintain the temperature of an object stored within the pocket for a period of time. In some embodiments, the perimeter edge comprises a drawstring configured to removably secure the base to the table. In another embodiment, the perimeter edge comprises an elastic material therein, wherein the elastic material is configured to removably secure the base to the table about a perimeter thereof. In other embodiments, the plurality of pockets further comprise a lining compartment therein, wherein the lining compartment is configured to removably secure the thermally insulated lining therein. In yet another embodiment, a flexible cover is disposed at each of the opposing ends of the base, wherein each flexible cover is configured to extend over each of the pair of panels when in a deployed position. In some embodiments, a fastener extends along each edge of an interior surface of the flexible cover, wherein the fastener is configured to removably secure to a complementary fastener disposed along each edge of the pair of panels. In another embodiment, an upper fastener is disposed on the base, wherein the upper fastener is configured to removably secure to a complementary fastener disposed on the flexible cover, such that the flexible cover is selectively movably between a stored position and the deployed position. In other embodiments, the base comprises a water-impermeable material. In yet another embodiment, at least one secondary pocket is disposed on at least one of the plurality of pockets. In some embodiments, a length of the pair of panels corresponds to a height of the table. In another embodiment, the base comprises a transparent material. In other embodiments, the plurality of pockets comprise a transparent material. In yet another embodiment, the pair of panels comprise a thermally insulated lining therein.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
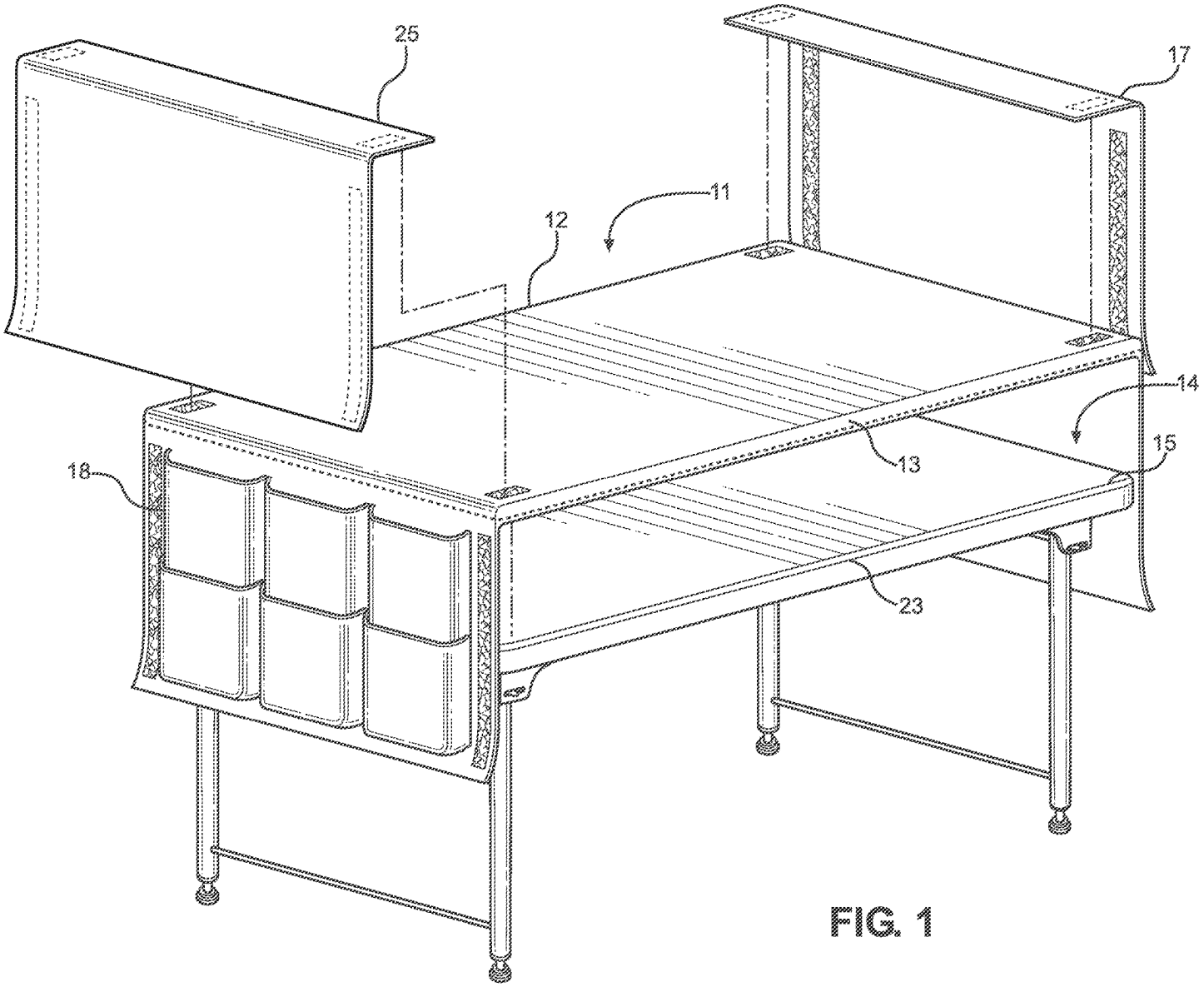
FIG. 1 shows an exploded view of an embodiment of the table cover and a table.

Reference is made herein to the attached drawings. Like reference numerals are used throughout the drawings to depict like or similar elements of the table cover. The figures are intended for representative purposes only and should not be considered to be limiting in any respect.

Referring now to FIG. 1, there is shown an exploded view of an embodiment of the table cover and a table. The table cover 11 comprises a flexible base 12 having a perimeter edge 13 configured to secure about an upper surface 15 of a table 14, such that the flexible base 12 rests flush against the upper surface 15. In some embodiments, the perimeter edge 13 comprises a drawstring therein, allowing the perimeter edge 13 to be cinched about a perimeter 23 of the table 14 to removably secure the table cover 11 thereto. In alternate embodiment, the perimeter edge 13 comprises an elastic material therein, wherein the elastic material is biased towards a diameter less than that of the table 14, such that the elastic material is configured to removably secure the table cover 11 about the perimeter 23 of the table 14. In some embodiments, the flexible base 12 comprises a water-impermeable material, such that the table 14 is protected from any external water sources, such as rain, sprinklers, and the like. In the illustrated embodiment, the entire table cover 11 comprises a transparent material such that the table 14 and any objects stored within the table cover 11 are readily visible.

Figure 3:
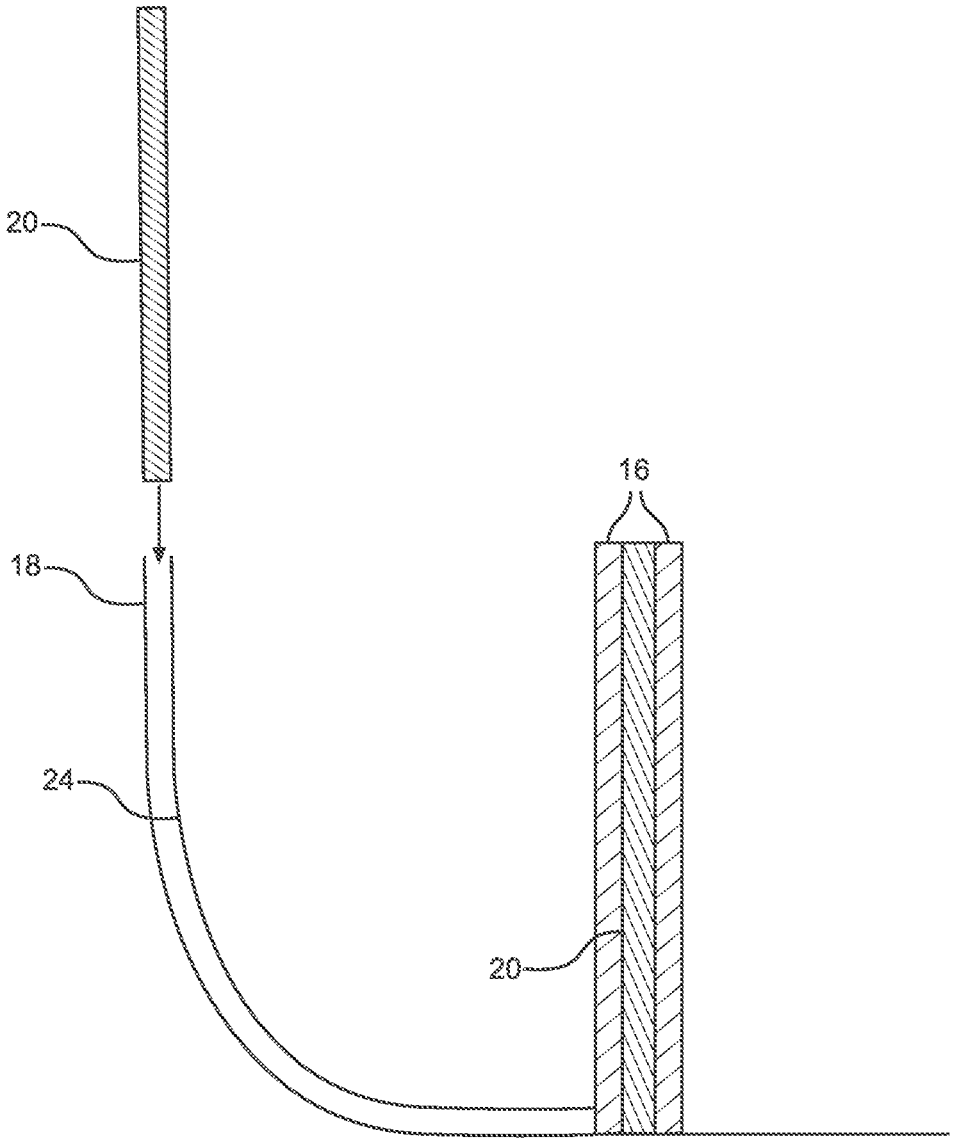
FIG. 3 shows a cross-sectional view of a pocket of an embodiment of the table cover.

The flexible base 12 further comprises a pair of panels 16 pivotally secured to opposing ends 17 of the flexible base 12. In some embodiments, the pair of panels 16 each comprise a length that corresponds to a height of the table 14, however, in alternate embodiments, panels 16 of various lengths are contemplated. The pair of panels 16 each comprise a plurality of pockets 18 thereon, wherein the plurality of pockets 18 are configured to store a variety of objects therein, such that a user is provided easily accessible storage space. Furthermore, at least one of the plurality of pockets 18 comprises a thermally insulated lining (as shown in FIG. 3, 20) configured to maintain the temperature of any objects stored therein. In the illustrated embodiment, the plurality of pockets 18, as well as the entirety of the table cover 11 comprise a transparent material, however, in alternate embodiments, only the plurality of pockets 18 comprise a transparent material, such that the user can easily identify objects stored therein.

A flexible cover 25 is affixed to the flexible base 12 at each of the opposing ends 17 thereof. The flexible cover 25 is selectively movable between a deployed position and a stored position, wherein the flexible cover 25 extends over the panel 16 when in the deployed position, thereby ensuring that the contents of the plurality of pockets 18 are protected thereby. In this way, rain, wind, and other external influences cannot interact with the contents of the plurality of pockets 18, ensuring that the contents remain in a desired position and condition for use. In some embodiments, the flexible cover 25 is removably securable to the flexible base 12 via an upper fastener (as shown in FIG. 4A, 30), such that the user can easily remove the flexible cover 25 for cleaning or storage purposes.

Figure 2:
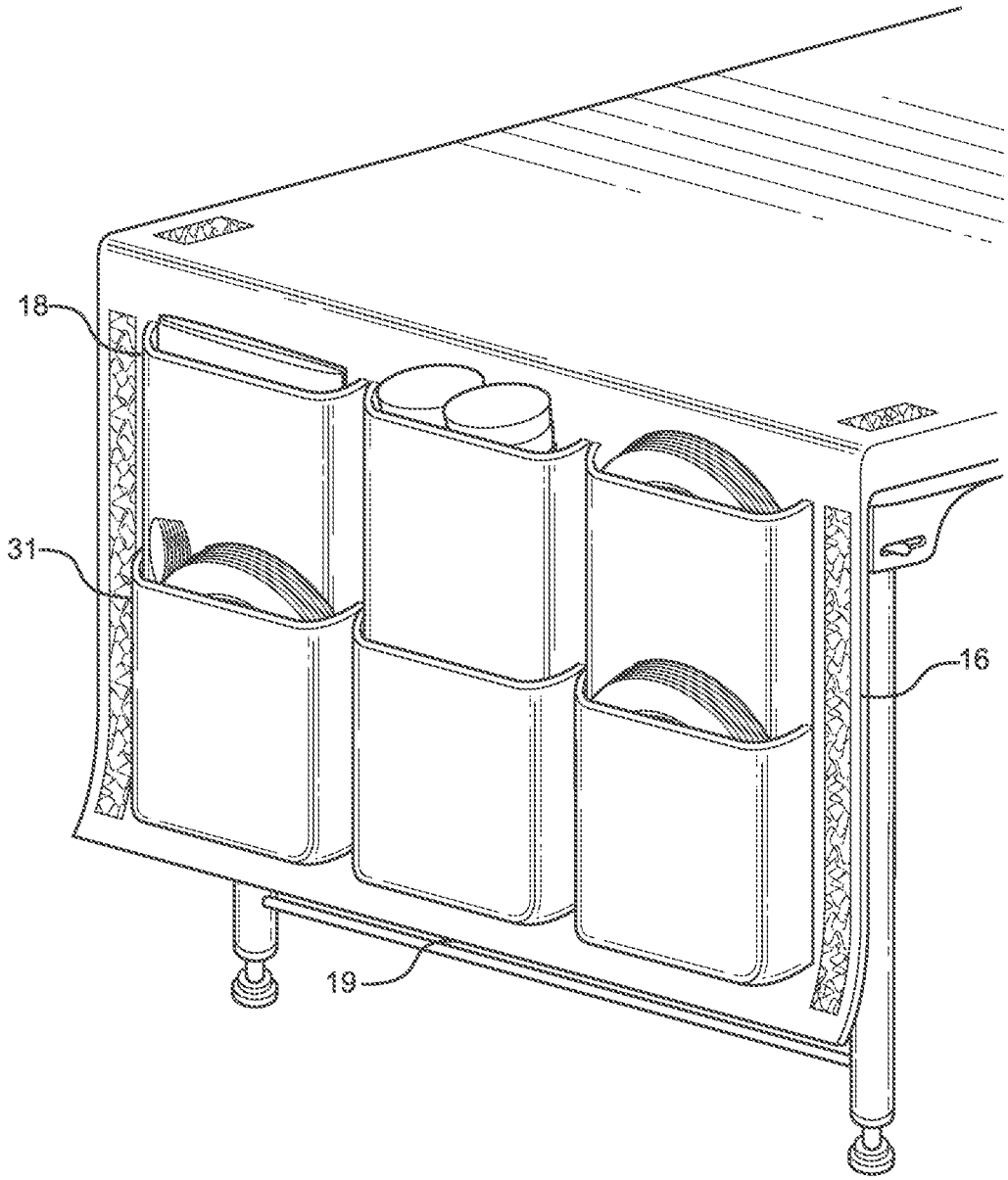
FIG. 2 shows a perspective view of a panel of an embodiment of the table cover.

Referring now to FIG. 2, there is shown a perspective view of a panel of an embodiment of the table cover. The plurality of pockets 18 are distributed across an exterior surface 19 of the panel 16. In some embodiments, the plurality of pockets 18 comprise various shapes and sizes to accommodate various contents, however, in the illustrated embodiment, each of the plurality of pockets 18 comprise a similar size and shape. Furthermore, in the illustrated embodiment, at least one secondary pocket 31 is affixed to one of the plurality of pockets 18, such that the user is provided additional storage space that is not otherwise constrained by the area of the exterior surface 19. In some embodiments, the secondary pocket 31 is affixed solely to one of the plurality of pockets, such that no contact is made with the exterior surface 19, thereby allowing the plurality of pockets 18 to extend along an entire length of the panel 16.

Referring now to FIG. 3, there is shown a cross-sectional view of a pocket of an embodiment of the table cover. At least one of the plurality of pockets 18 comprises a thermally insulated lining 20 disposed therein. In the illustrated embodiment, the thermally insulated lining 20 is removably securable within a lining compartment 24 within the pocket 18. In this way, the user can easily remove or replace the thermally insulated lining 20 as desired. Additionally, the user can customize their table cover by installing a desired thermally insulated lining 20 within each of the plurality of pockets 18, such that each pocket 18 provides a desired amount of insulation. In some embodiments, the panel 16 further comprises a thermally insulated lining 20 therein, such that an entire interior volume of the pocket 18 is thermally insulated from all sides, simultaneously preventing heat transfer through the panel 16 and a wall of the pocket 18.

Figure 4A:
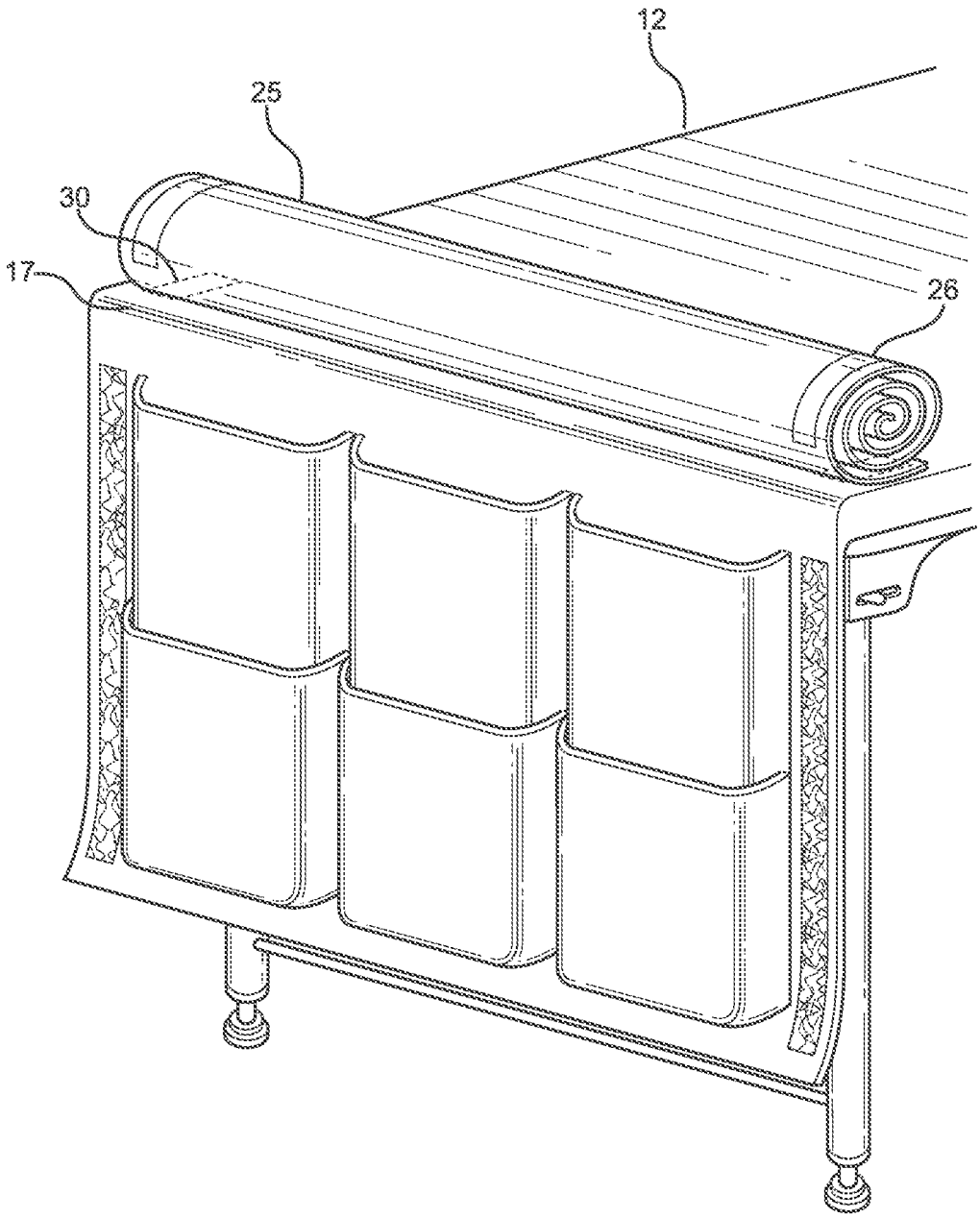
FIG. 4A shows a perspective view of a flexible cover of an embodiment of the table cover in a stored position.
Figure 4B:
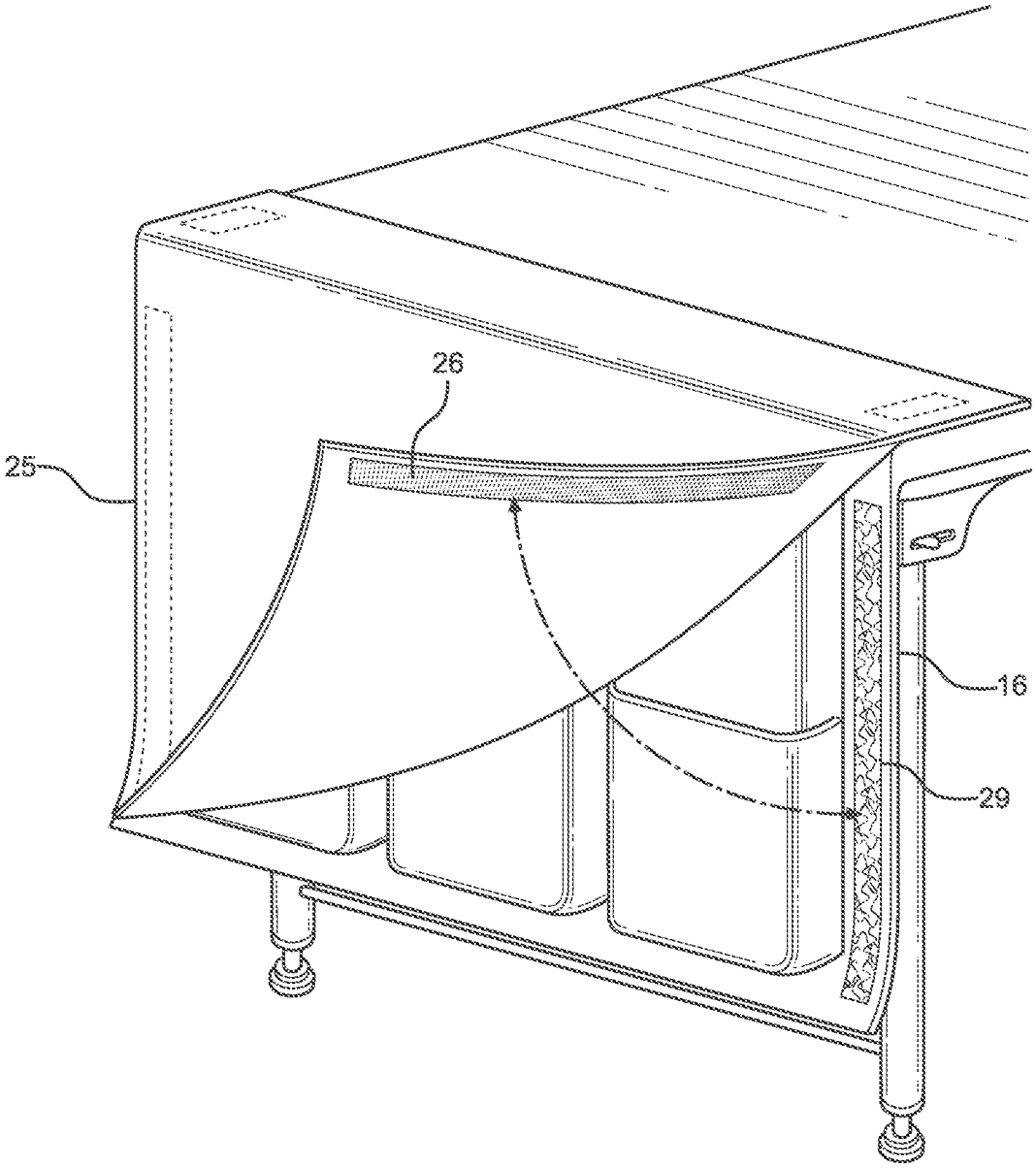
FIG. 4B shows a perspective view of a flexible cover of an embodiment of the table cover in a deployed position.

Referring now to FIGS. 4A and 4B, there is shown a perspective view of a flexible cover of an embodiment of the table cover in a stored position and a perspective view of a flexible cover of an embodiment of the table cover in a deployed position, respectively. In the illustrated embodiment, the flexible cover 25 is affixed to the flexible base 12 along opposing ends 17 thereof. The flexible cover 25 is selectively movable between a stored position (as shown in FIG. 4A) and a deployed position (as shown in FIG. 4B). When in the stored position, the flexible panel 25 exposes the plurality of pockets for use, whereas, in the deployed position, the flexible panel 25 extends over the plurality of pockets to provide protection to the contents thereof. In one embodiment, the flexible cover 25 is removably securable to the flexible base 12 via the upper fastener 30, however, in alternate embodiments, the upper fastener 30 serves to secure the flexible cover 25 in the stored position via a fastener 26 extending along each edge of an interior surface of the flexible cover 25.

In the illustrated embodiment, the pair of panels 16 further comprise a complementary fastener 29 extending along each edge of the panel 16, wherein the complementary fastener 29 is configured to removably secure to the fastener 26 disposed along the interior surface of the flexible cover 25. In this way, the flexible cover 25 can be removably secured to the pair of panels 16 when in the deployed position, such that the flexible cover 25 retains a desired position in spite of external forces, such as windy conditions.

In one exemplary use, the user can place the table cover on the table such that the flexible base 12 extends across an entirety of the upper surface of the table and the pair of panels 16 hang over opposing ends of the table. The table cover can then be secured to the table via the drawstring or elastic system extending about the perimeter edge of the flexible base 12. The flexible cover 25 can be placed in the stored position, such that the user can retrieve items stored within the plurality of pockets, and then returned to the deployed position to protect the contents of the plurality of pockets from inclement weather. In some embodiments, the flexible cover 25 can be secured to the panel 16 via the fastener 26 and the complementary fastener 29 to further ensure no debris, rain, or the like interferes with the items stored within the plurality of pockets. Items that the user wishes to retain a desired temperature can be stored within pockets having a thermally insulated lining, such that the item does not significantly vary in temperature over a limited time.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A table cover, comprising:

a flexible base having a perimeter edge configured to secure to a table such that an entirety of an upper surface of the table is covered by the base;

a pair of panels pivotally affixed to opposing ends of the base;

wherein the pair of panels further comprise a plurality of pockets on an exterior surface thereof;

wherein at least one of the plurality of pockets comprises a thermally insulated lining, wherein the thermally insulated lining is within an outer pocket wall of the pocket of the plurality of pockets;

wherein the thermally insulated lining is disposed between an interior layer of the outer pocket wall and an exterior layer of the outer pocket wall;

wherein the outer pocket wall of each of the plurality of pockets further comprises a lining compartment therein, wherein the lining compartment is defined between the interior layer and the exterior layer of the outer pocket wall;

wherein the lining compartment is configured to removably secure the thermally insulated lining therein;

wherein an interior volume of the pocket is isolated from the thermally insulated lining.

2. The table cover of claim 1, further comprising a flexible cover disposed at each of the opposing ends of the base, wherein each flexible cover is configured to extend over each of the pair of panels when in a deployed position.

3. The table cover of claim 2, wherein a fastener extends along each edge of an interior surface of the flexible cover, wherein the fastener is configured to removably secure to a complementary fastener disposed along each edge of the pair of panels.

4. The table cover of claim 2, wherein the flexible cover is removably securable to the base via an upper fastener disposed thereon.

5. The table cover of claim 2, further comprising an upper fastener disposed on the base, wherein the upper fastener is configured to removably secure to a complementary fastener disposed on the flexible cover, such that the flexible cover is selectively movable between a stored position and the deployed position.

6. The table cover of claim 1, wherein the base comprises a water-impermeable material.

7. The table cover of claim 1, wherein at least one secondary pocket is disposed on at least one of the plurality of pockets.

8. The table cover of claim 1, wherein a length of the pair of panels is less than that of a height of the table.

9. The table cover of claim 1, wherein the base comprises a transparent material.

10. The table cover of claim 1, wherein the plurality of pockets comprise a transparent material.

11. The table cover of claim 1, wherein the pair of panels comprise a thermally insulated lining therein.

* * * * *